United States Patent [19]

Smith

[11] 4,116,802

[45] Sep. 26, 1978

[54] ELECTROLYTIC DIAPHRAGM CELLS

[75] Inventor: Frank Smith, Runcorn, England

[73] Assignee: Imperial Chemical Industries Limited, London, England

[21] Appl. No.: 817,677

[22] Filed: Jul. 21, 1977

[30] Foreign Application Priority Data

Aug. 4, 1976 [GB] United Kingdom ..... 32490/76
Sep. 10, 1976 [GB] United Kingdom ..... 37604/76

[51] Int. Cl.[2] ..... C25B 9/00; C25B 11/02; C25B 11/10

[52] U.S. Cl. ..... 204/252; 204/288; 204/290 F

[58] Field of Search ..... 204/252, 288, 289, 290 R, 204/290 F, 253-266

[56] References Cited

U.S. PATENT DOCUMENTS 3,443,055 5/1969 Gwynn et al. ..... 204/290 F
3,598,715 8/1971 Goens et al. ..... 204/290 F
3,956,097 5/1976 Denora et al. ..... 204/252

*Primary Examiner*—John H. Mack
*Assistant Examiner*—D. R. Valentine
*Attorney, Agent, or Firm*—Cushman, Darby & Cushman

[57] ABSTRACT

An assembly for an electrolytic cell comprising a base plate of an electrically conductive metal which is unattacked by the electrolyte to be used in the cell, e.g. titanium, a plurality of anodes or anode support members mounted on and attached in electrical contact with one surface of the base plate, and an electrical conductor in the form of a metallic sheet electrically conductively bonded to the other surface of the base plate, e.g. a sheet of iron or steel, the bonding having been achieved by placing a metallic inter layer between the base plate and the conductor sheet, heating the inter layer to a temperature of at least 427° and to a temperature at which the inter layer is molten, and applying elevated pressure to the base plate and to the conductor sheet.

14 Claims, 3 Drawing Figures

ELECTROLYTIC DIAPHRAGM CELLS

This invention relates to improvements in diaphragm or membrane cells for the electrolysis of aqueous solutions of alkali metal halides, particularly alkali metal chlorides.

In recent years graphite anodes for electrolytic diaphragm cells have been superseded by permanent anodes fabricated from electrolyte-resistant metals, for example titanium. In the case of the consumable graphite anodes it was common practice to have the lower ends of the anodes connected to copper conductor bars or alternatively cast in a lead slab which formed part of the base of the cells. A protective coating such as concrete or bitumen was then applied to protect the conductor bars or lead casting from the corrosive effect of chlorinated brine during operation of the cell. The introduction of metal anodes, which may be provided with an electrocatalytically active coating, resulted in significant changes in the design of anode assemblies for diaphragm cells. These changes resulted partly from the fact that the coated metal anodes had a considerably longer working life than comparable graphite anodes. More important, however, was the fact that whilst a graphite anode is consumed during operation of the cell and has to be replaced by a new anode when its active life has terminated, a metal anode simply has to be recoated when its electrocatalytically active coating has reached the end of its working life. It follows that the cumbersome techniques employed for protecting the current lead-in means for graphite anodes were not suitable for metal anodes which had to be easily removable from the cells for recoating. At the same time however the means for leading current in to the lower ends of the metal anodes had still to be protected from the corrosive effects of the electrolyte. Experience showed that in the case of metal anodes the best results were obtained by providing the cell with a base constructed of a metal which was electrically conductive and which was also unattacked by the electrolyte used in the cell. By reason of its excellent durability and reasonable cost titanium has proved to be the most suitable metal for the construction of such cell bases. In such a construction the metal anodes are mounted on one side of the titanium base and an electrical conductor or conductors are bonded to the other side of the base so as to lead current into the metal anodes.

Examples of diaphragm cells fitted with metal bases are disclosed in *UK* Patent Specification Nos. 1,125,493 and 1,127,484. In both specifications coated titanium anodes are releasably mounted on rib members which act as anode supports and which are fitted to one side of a titanium plate. Copper, aluminum or steel conductors are mechanically and electrically bonded to the underside of the base plate in the vicinity of the metal anodes. Several types of construction of conductors and several methods of effecting the bond between the titanium base plate and the conductors are described. For example, the conductor may take the form of a single sheet of metal bonded to the entire under surface of the base plate or, alternatively, a series of parallel strips of the conductor metal may be bonded to the under surface of the base plate directly beneath the anode supports. Steel or copper conductor plates may be clad with titanium by providing an interlayer of bond-promoting metal or alloy and rolling the metals together. Alternatively, the metals may be joined together by explosion bonding.

They may also be bonded together locally by resistance welding. In the case where the conductors are of copper, soldering of the conductors to the titanium base plate is preferred. Finally, when aluminum is used as the conductor material the bond may be effected by casting molten aluminium on to the titanium base.

It is particularly desirable for the base plate of an electrolytic cell, to which the anodes or anode support members are attached in electrical contact, to be bonded on its under surface to an electrical conductor which is in the form of a sheet. Use of such a sheet bonded to substantially the whole of the under surface of the base plate has the advantage that the current lead-ins need to be attached at the edges of the sheet only, especially where a relatively thick conductor sheet is used, and need not be attached beneath the base plate in the region of the anodes or anode support members. Thus, attachment of current lead-ins may be more readily effected. Furthermore, if the conductor sheet is of sufficient thickness, for example if it is in the form of a slab, the sheet may be self-supporting and in effect form the base of the cell.

However, difficulties may be experienced in achieving a satisfactory bond between the base plate and the conductor sheet over the whole of the surfaces of the base plate and conductor sheet which are to be bonded together due to imperfections in the surfaces. For example, the surfaces may not be sufficiently flat and voids may be present between the adjacent surfaces.

We have now found a particularly suitable method of achieving an efficient mechanical and electrical bond between a base plate of an electrolytic cell and a metallic conductor in the form of a sheet which overcomes the aforementioned difficulty.

According to the present invention we provide an assembly for an electrolytic cell the assembly comprising a base plate of an electrically conductive metal which is unattacked by the electrolyte to be used in the cell, a plurality of anodes or anode support members mounted on and attached in electrical contact with one surface of the base plate, and an electrical conductor in the form of a metallic sheet electrically conductively bonded to the other surface of the base plate, the bonding having been achieved by placing a metallic inter layer between the base plate and the conductor sheet, heating the inter layer to a temperature of at least 427° and to a temperature at which the inter layer is molten, and applying elevated pressure to the base plate and to the conductor sheet.

The base plate, which suitably has a thickness in the range 0.04 inch to 0.125 inch may be provided with a series of spaced parallel anode support members of a material which is electrically conductive and which is unattacked by the electrolyte to be used in the cell and the anodes may be bonded, e.g. welded to said support members.

Alternatively, the anodes may be welded directly to the upper surface of the metal base plate.

In a preferred embodiment, however, the anode support members may take the form of rows of spaced studs or posts which may be friction welded or capacitance discharge stud welded to the base plate. The use of capacitor discharge stud welding is advantageous in that it does not interfere with the bond between the base plate and the sheet of electrical conductor, and is cheap and readily carried out with little or no special expertise.

The base plate and the anode support members are preferably made from titanium. However tantalum or niobium may also be used. Alloys of the aforesaid metals are also suitable.

The anodes are preferably made from titanium or a titanium-base alloy having anodic polarisation properties similar to those of titanium.

The anodes may be provided with any of the electrocatalytically active coatings known in the art. For example, coatings based on a platinum group metal oxide, e.g. ruthenium oxide may be used. Alternatively, the coating may comprise a platinum group metal or alloy thereof, e.g. platinum or platinum-iridium respectiveley.

The conductor sheet which is electrically conductively bonded to the under surface of the base plate should be of a metal of greater electrical conductivity than that of the base plate and preferably is a sheet of copper, aluminum, iron or steel, e.g. mild steel.

The conductor sheet may be of any desired thickness but suitably has a thickness of at least one-quarter inch. Where the conductor sheet is to be self-supporting and form the base of the electrolytic cell, and especially where it is of iron or steel, it suitably has a thickness of at least 1 inch, for example a thickness in the range 1 inch to 8 inches, e.g. 3 inches to 6 inches.

Where the conductor sheet is relatively thin the current lead-in may be bonding to an extention of the conductor sheet projecting beyond the edge of the base plate. Where the conductor sheet is relatively thicker, for example where it is a slab of iron or steel, the current lead-in may be bonded to the edge of the conductor sheet.

The conductor may be of tapering cross-section decreasing in the direction of diminishing current.

As elevated pressure is applied to the base plate and the conductor sheet in the bonding process it is most convenient to effect this bonding before mounting the anodes or anode support members on the upper surface of the base plate.

We find that where the bonding of the base plate to the electrical conductor sheet is effected at elevated temperature and pressure the imperfections which may be present in the base plate and the sheet, and especially in the base plate, for example deviations from flatness of the surfaces of the base plate and sheet, may be removed. Thus voids which may otherwise be present between the base plate and the sheet, and which would hinder formation of a mechanically strong bond between the surfaces, may be removed. It is belived that use of elevated pressure and temperature causes the base plate to creep slightly thus eliminating voids which may be present by a process of creep flattening due to stress relaxation under constant load.

Provided the temperature is sufficiently high it is not necessary to apply very high pressures. A pressure of 15 lb/sq in, e.g. in the range 2 to 15 lb/sq in, or possibly somewhat higher, may be suitable. The pressure may be achieved, for example, by the application of an external load suitably whilst maintaining an inert atmosphere in the vicinity of the surfaces to be joined. It is preferred to effect the bonding under vacuum whereby atmospheric pressure effectively provides the load required to hold the two surfaces together, although additional external pneumatic or hydraulic pressure loading may be provided if desired.

The bonding may be effected in a chamber which is closed by means of a flexible membrane, for example a metal or rubber membrane, or by means of a piston, and which is capable of evacuation. The base plate and electrical conductor sheet may be placed in the chamber, the chamber may be evacuated, and the flexible membrane or piston may be caused to bear directly, or indirectly, for example through a load spreader, e.g. through a glass a ceramic fibre mat, on the surface of the base plate and/or on the surface of the electrical conductor sheet thereby applying elevated pressure. Suitably, the bonding may be carried out at a pressure in the range from $10^1$ mm to $10^{-5}$ mm of mercury, for example at about $10^{-3}$ mm. It is believed that operating under vacuum conditions advantageously reduces void formation at the joint, and decreases oxidation of the metal of the base plate, especially thereby strengthening the joint obtained.

The chamber should be provided with heating means, e.g. heating platens. The temperature used should be at least 427° C. and should be sufficiently high that the metallic inter layer is molten, and the temperature will also be lower than the melting point of metal of the base plate and of the metal of the electrical conductor.

In general a temperature of at least 600° C., and preferably a temperature in the range 800° C. to 1000° C. will be used.

The temperature also depends on the melting point of the metallic inter layer and on the particular metals being bonded, but in general the bonding may be carried out at a temperature in the range 20° to 100° C., for example about 50° C., above the melting point of the metallic interlayer.

The time of contact between the base plate and the electrical conductor sheet, that is the time for which elevated pressure is applied at the temperature of the bonding process, depends on the size (thermal mass) of the base plate and conductor sheet being bonded but is conveniently in the range 15 to 30 minutes when low thermal masses are concerned, but may be several hours, for example up to 6 hours, e.g. 4 to 6 hours, when bonding metals of large thermal mass. The time is also desirably sufficient for the imperfections in the base plate and/or the electrical conductor sheet to be removed.

The time for which the base plate and the electrical conductor sheet are held together at elevated temperature and pressure determines the type of bond between the base plate and the conductor sheet. The bond may be a so-called liquid metal accelerated diffusion bond whereby the base plate and the electrical conductor sheet are held in contact with a liquid metallic inter layer at elevated pressure and under such conditions of temperature and pressure and for a sufficient period of time that diffusion of the metallic inter layer takes place into the base plate and into the electrical conductor sheet and vice versa to an extent such that melting temperature of the liquid phase is raised and it eventually solidifies.

Where the conditions of temperature and/or the period of time is such that the extent of diffusion of the metallic inter layer is less than that which takes place in the liquid metal accelerated diffusion bonding process the bonding process may be considered to be a brazing process.

Suitable metallic interlayers for use in the bonding of, for example titanium and mild steel, include copper, silver, and alloys of silver, for example silver/copper, silver/indium and silver/aluminium alloys. It is preferred to use silver/copper alloys. Specific alloys which are suitable include 93% Ag/7% Cu (melting point 830°-900° C.), 72% Ag/28% Cu (melting point 780° C.), 85% Ag/15% In (melting point 790°-860° C.), and 95% Ag/5% Al (melting point 790°-820° C.).

The metallic inter layer is conveniently in the form of a thin metallic foil which can be interposed between the surfaces to be bonded. Metallic foils having a thickness of at least 10 microns, e.g. in the range 10-200 microns, for example 75-125 microns, are suitable.

Typically, mild steel and titanium plates may be joined under conditions of $10^{-3}$ mm of mercury pressure, 15 lb/sq in loading, 60 minutes duration at temperatures of 950° C. (when using 93% Ag, 7% Cu), 830° C. (72% Ag, 28% Cu), 910° C. (85% Ag, 15% In) and 870° C. (95% Ag, 5% Al).

The present invention also includes an electrolytic cell fitted with an assembly as described. The cell may comprise any suitable diaphragm material. For example, an asbestos diaphragm, or a diaphragm of a fluoropolymer, e.g. polytetrafluoroethylene. The cell may be a membrane cell.

An embodiment of the invention will now be described simply by way of example with reference to the accompanying drawings in which.

Figures 1, 2:
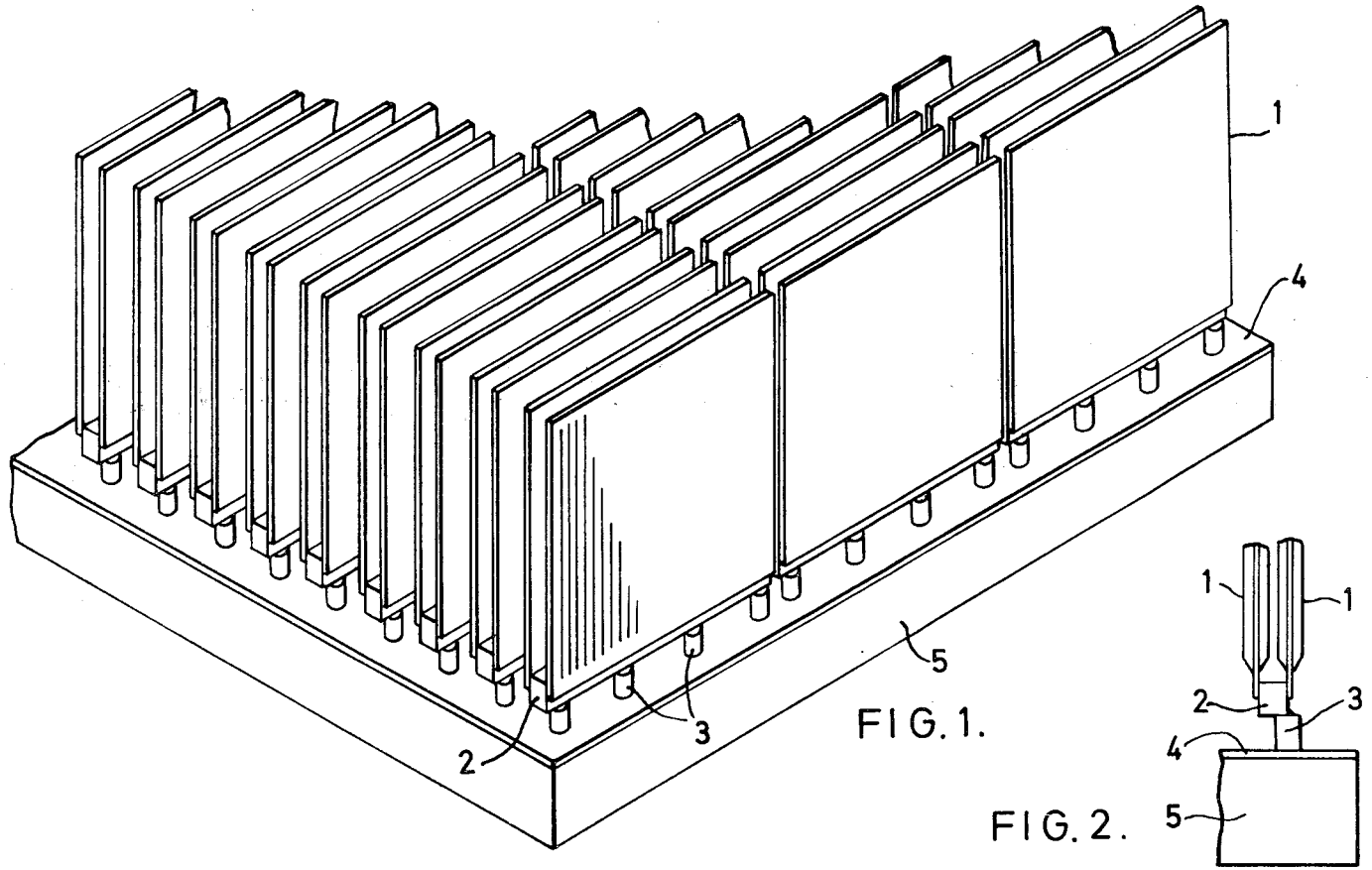
FIG. 1 is a diagrammatic view of an assembly according to the invention
FIG. 2 is a front elevation of part of the assembly of FIG. 1.
Figure 3:
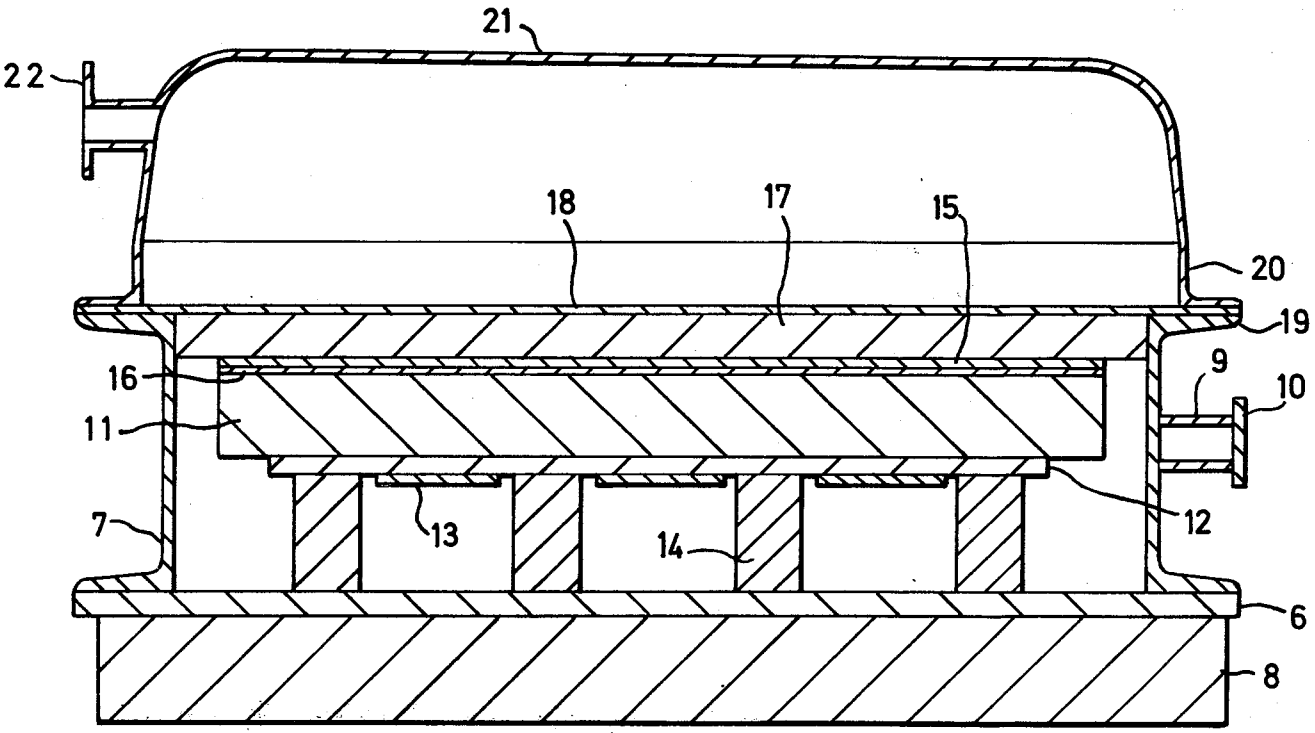
FIG. 3 is a cross-sectional view of an apparatus for the bonding of titanium to mild steel.

Referring to the drawings, the assembly comprises a plurality of pairs of sheet anodes 1, e.g. louvred sheet anodes, fabricated of titanium and provided with an electrocatalytically active coating, for example ruthenium oxide and titanium dioxide, which are resistance seam welded at their lower ends to titanium bridge pieces 2. The bridge pieces 2 are argon-arc welded to titanium studs 3 which are in turn capacitor discharge stud welded to a titanium sheet 4 which serves as the base plate of the assembly. The titanium base plate 4 is bonded to a mild steel slab 5, using the apparatus shown in FIG. 3 (as described below), and preferably using a silver/copper alloy as the metallic interlayer. The mild steel slab serves as a conductor providing a low-resistance electrical flow path between the anodes 1 and copper connectors (not shown) bolted to a side edge of the mild steel slab 5. The titanium base plate is provided with a drainage hole or holes (not shown).

The bonding apparatus (shown in FIG. 3) comprises a mild steel vessel having a base 6 and side-walls 7. The vessel is supported on a mild steel frame 8. The side-walls 7 are provided with an exit pipe 9 fitted with a flange 10 for connection to a vacuum pump (not shown). A mild steel slab 11 (part of the cell base) is placed on a mild steel platen 12 provided with heating elements 13, and the slab 11 and platen 12 are supported on legs 14 of insulating material. A titanium plate 15, forming the cell base plate, is placed on the upper surface of the mild steel slab 11, and a metallic inter layer 16, for example a silver alloy, is interposed between the titanium plate 15 and the mild steel slab 11. The titanium plate 15 is covered with a layer of insulating material 17, which also acts as a uniform load spreader, and the vessel is covered with a flexible metal diaphragm 18 which is sealed between a flange 19 on the side-walls 7 and a flanged cover 20. If desired, the flanged cover 20 may be provided with a dome-shaped top 21 having a flanged exit pipe 22.

The vessel was evacuated to a pressure in the range $10^{-1}$ mm to $10^{-5}$ mm, for example $10^{-3}$ mm, of mercury, corresponding to a loading of about 15 lb/sq in on the upper surface of the titanium plate 15 (as exerted through the membrane 18 and the insulating material 17). The mild steel slab 11 was heated to a temperature in the range 20°-100° C., for example about 50° C., above the melting point of the metallic inter layer 16. Typical temperatures were as follows:

| Temperature | Metallic interlayer |
|---|---|
| 950° C | 93% Ag, 7% Cu |
| 830° C | 72% Ag, 28% Cu |
| 910° C | 85% Ag, 15% In |
| 870° C | 95% Ag, 5% Al |

The temperature and vacuum were maintained for a period of 60 minutes and the titanium base plate bonded to the mild steel slab was then allowed to cool and was then removed from the vessel. In each case the titanium base plate was found to be firmly bonded to the mild steel slab. Examination of the bond showed that liquid metal accelerated diffusion bonding had taken place.

If desired extra pressure may be exerted on the membrane 18 and thence via the insulating material 17 onto the titanium plate 15, by applying fluid pressure through the pipe 22, for example, by introducing compressed air through the pipe 22.

What we claim is:

1. An assembly for an electrolytic cell the assembly comprising a base plate of an electrically conductive metal which is unattacked by the electrolyte to be used in the cell, a plurality of anodes or anode support members mounted on and attached in electrical contact with one surface of the base plate, and an electrical conductor in the form of a metallic sheet electrically conductively bonded to the other surface of the base plate, the bonding having been achieved by placing a metallic inter layer between the base plate and the conductor sheet, heating the inter layer to a temperature at which the inter layer is molten, which temperature is at least 427° C. but is lower than the melting points of the base plate and the conductor sheet, and applying elevated pressure to the base plate and to the conductor sheet sufficient to substantially eliminate voids between the base plate and the conductor sheet.

2. An assembly as claimed in claim 1 in which the base plate and the anode support members are made of titanium.

3. An assembly as claimed in claim 2 in which the anodes are made of titanium.

4. An assembly as claimed in claim 1 in which the anode support members are rows of spaced studs or posts.

5. An assembly as claimed in claim 1 in which the electrical conductor is a sheet of iron or steel.

6. An assembly as claimed in claim 1 in which the anodes are coated with an electrocatalytically active coating.

7. An assembly as claimed in claim 1 in which the metallic inter layer is silver or a silver alloy.

8. An assembly as claimed in claim 1 in which the bonding is effected at a temperature in the range 20° to 100° C. above the melting point of the metallic inter layer.

9. An assembly as claimed in claim 1 in which the bonding is effected at an applied pressure in the range 2 to 15 lb/sq in.

10. An assembly as claimed in claim 1 in which bonding is effected for a time in the range 15 minutes to 6 hours.

11. An assembly as claimed in claim 1 in which the bonding is effected by a liquid metal accelerated diffusion bonding process.

12. An electrolytic cell suitable for the electrolysis of aqueous alkali metal halide comprising an assembly as claimed in claim 1.

13. An electrolytic cell as claimed in claim 12 which is a diaphragm cell.

14. A method of constructing an assembly for an electrolytic cell comprising the steps of providing a base plate of an electrically conductive metal which is unattacked by cell electrolyte, providing a plurality of anodes operatively mounted on and attached in electrical conductive relationship with one surface of the base plate, and bonding an electrical conductor in the form of a metallic sheet to the other surface of the base plate by placing a metallic inter layer between the base plate and the conductor sheet, heating the inter layer to a temperature at which the inter layer is molten, which temperature is at least 427° C. and is lower than the melting points of the base plate and the conductor sheet, and applying elevated pressure to the base plate and to the conductor sheet sufficient to substantially eliminate voids between the base plate and the conductor sheet.

* * * * *